US006659374B1

(12) United States Patent
Chiera

(10) Patent No.: US 6,659,374 B1
(45) Date of Patent: Dec. 9, 2003

(54) SPRAY HEAD

(75) Inventor: Dante Vincenzo Chiera, Mullalyup (AU)

(73) Assignee: Goldenvale Pty Ltd., East Fremantle (AU); part interest ( * ) Notice: Subject to any disclaimer, the term of this patent is extended or adjusted under 35 U.S.C. 154(b) by 0 days.

(21) Appl. No.: 09/674,723

(22) PCT Filed: May 5, 1999

(86) PCT No.: PCT/AU99/00330

§ 371 (c)(1),
(2), (4) Date: Nov. 3, 2000

(87) PCT Pub. No.: WO99/56887

PCT Pub. Date: Nov. 11, 1999

(30) Foreign Application Priority Data

May 5, 1998 (AU) ..... PP3318

(51) Int. Cl.[7] ..... B05B 1/00

(52) U.S. Cl. ..... 239/587.2; 239/164; 239/251; 239/263.1; 239/589

(58) Field of Search ..... 239/164, 165, 239/166, 251, 256, 587.1, 587.2, 589, 263.1; 169/24; 901/43; 285/181, 147.3, 147.1

(56) References Cited

U.S. PATENT DOCUMENTS

| | | | | | |
|---|---|---|---|---|---|
| 2,678,367 | A | | 5/1954 | Eisenburger | |
| 3,074,649 | A | * | 1/1963 | Atkinson | 239/587.2 |
| 3,472,451 | A | | 10/1969 | Orem et al. | |
| 3,770,062 | A | * | 11/1973 | Riggs | 169/24 |
| 3,895,756 | A | | 7/1975 | Jaeger | |
| 4,223,313 | A | | 9/1980 | Chabrol | |
| 4,411,386 | A | | 10/1983 | Disbrow | |
| 4,447,007 | A | * | 5/1984 | Farines | 239/165 |
| 5,211,245 | A | * | 5/1993 | Relyea et al. | 169/24 |
| 5,358,588 | A | | 10/1994 | Okano et al. | |
| 5,720,310 | A | | 2/1998 | Moulder | |
| 5,735,627 | A | * | 4/1998 | Nagao et al. | 285/147.3 |
| 5,788,158 | A | * | 8/1998 | Relyea | 239/166 |
| 5,899,276 | A | * | 5/1999 | Relyea et al. | 239/166 |

FOREIGN PATENT DOCUMENTS

| | | |
|---|---|---|
| AU | 37687 | 7/1973 |
| EP | 0 274 322 | 7/1988 |
| GB | 2 219 226 | 12/1989 |
| WO | WO93/09880 | 5/1993 |

* cited by examiner

*Primary Examiner*—Steven J. Ganey
(74) *Attorney, Agent, or Firm*—Bachman & LaPointe, P.C.

(57) ABSTRACT

A spray head which includes a plurality of interconnected hollow spindles wherein each of the hollow spindles is arranged to be axially rotated and means is provided for fluid flow through the spindles sequentially. Each of the spindles is provided with at least one motor configured so as to facilitate, in use, 360° rotation of the hollow spindle about a central longitudinal axis thereof, each hollow is substantially perpendicular to an adjacent hollow spindle.

13 Claims, 8 Drawing Sheets

SPRAY HEAD

FIELD OF THE INVENTION

The present invention relates to a spray head. It is known to provide a device which directs sprays of various fluids for, but not limited to, agricultural, industrial, fire and general spraying or application purposes. Efficient and economical spraying of liquids on a proposed target is facilitated by accurate placement of a spray nozzle in relation to the location, size and scope of the proposed target.

In an agricultural context, the vast majority of spraying conducted world-wide is catered for by self-propelled sprayers and tractor drawn sprayers with wide booms, as well as misting type blowers. In these applications the operator is protected within the safe environment of an enclosed cab in the vehicle to which the sprayer is attached.

Where localised spraying is required or where the target area is inaccessible to purpose built spraying equipment, sprays are applied directly on the target area by an individual using a hand gun on a knapsack sprayer, or a hand gun on a power sprayer with a long hose that retracts on to a hose reel.

Manual direct application by an individual is the least desirable spraying method because of the high risk of chemical contamination of the operator. Although operators are recommended to wear fill protective clothing, including special overalls, boots, gloves, head shield and respirator, many operators discard elements of their protective clothing in order to be more comfortable in hot and humid weather conditions.

The present invention provides the manoeuvrability and accurate placement of the spray nozzle directing the spray at the target area generally only provided by manual hand spraying, thus removing the need for an individual operator to be in the immediate target area when specific localised spraying is required and eliminates the requirement of unreeling hoses and sprayers prior to operation. Furthermore, the subsequent retraction of hoses prior to vacating to another spraying area is also avoided.

BRIEF DESCRIPTION OF THE INVENTION

In accordance with one aspect of the present invention there is provided a spray head which includes a plurality of interconnected hollow spindles wherein each of the hollow spindles is arranged to be axially rotated and means is provided for fluid flow through the spindles sequentially.

DESCRIPTION

The present invention will now be described, by way of example, with reference to the accompanying drawings, in which.

Figure 1:
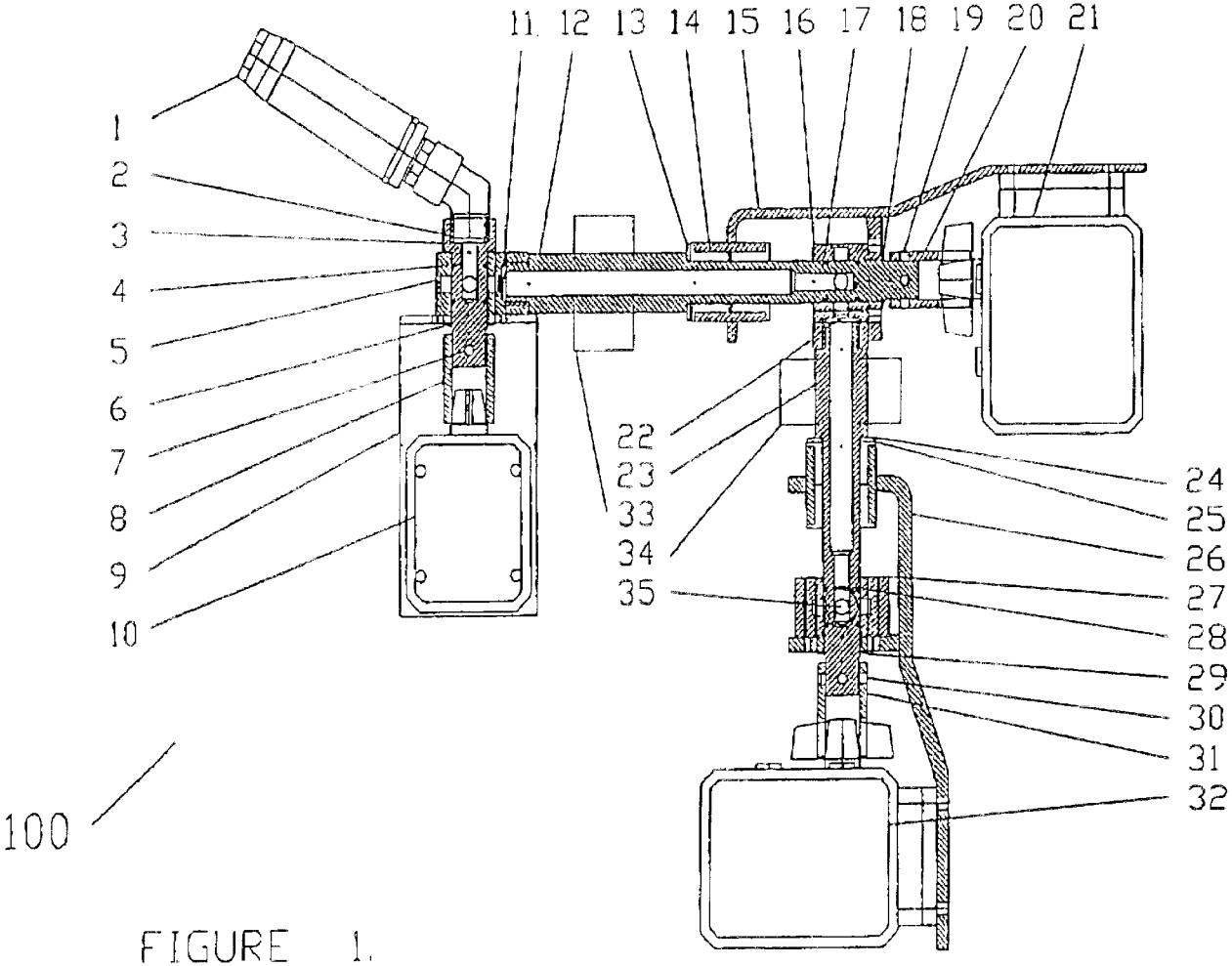
FIG. 1 is a cross sectional side view of a spray head of the present invention.

Referring to FIG. 1 there is shown a spray head 100. The spray head 100 includes a spray nozzle 1 interconnected to a first hollow spindle 3 which is rotatably interconnected to a second hollow spindle 12. The second hollow spindle 12 is rotatably interconnected to a third hollow spindle 23. Further means are provided to enable liquid to flow through sequentially the third hollow spindle 23, the second hollow spindle 12, the first hollow spindle 3 and the spray nozzle 1.

The first hollow spindle 3 is provided with a first motor 10 configured so as to facilitate, in use, 360° rotation of the first hollow spindle 3 about a central longitudinal axis of the first hollow spindle 3. The first hollow spindle 3 is rotated by the first motor 10 through a coupling 8, wherein the coupling 8 is attached to the first hollow spindle 3 by a roll pin 7. The first hollow spindle 3 rotates within a swivel block S. Leakage of flowing liquid therebetween is prevented by the provision of O-ring seals therebetween, The first hollow spindle 3 is retained within the swivel block 5 by a circlip 6. The swivel block 5 is attached to a base 9 by a set of screws, wherein the base 9 provides support for the first motor 10. The base 9 provides a means of maintaining the first motor 10 in a non-rotating position relative to the second hollow spindle 12 whilst the first hollow spindle 3 rotates.

The first hollow spindle 3 is rotatably interconnected and substantially perpendicular to the second hallow spindle 12. The first hollow spindle 3 and the second hollow spindle are rotatably interconnected via the swivel block 5. A seal ring 11 is provided therebetween to prevent liquid leaking between the swivel block interface of the first hollow spindle 3 and the second hollow spindle 12.

The second hollow spindle 12 is provided with a second motor 21 configured so as to facilitate, in use, 360° rotation of the second hollow spindle 12 about a central longitudinal axis of the second hollow spindle 12. The second hollow spindle 12 is rotated by the second motor 21 through a coupling 20, wherein the coupling 20 is attached to the second Silo hollow spindle 12 by a roll pin 19. The second hollow spindle 12 rotates within a swivel block 16. Leakage of flowing liquid therebetween is prevented by the provision of O-ring seals 17 therebetween. The second hollow spindle 12 is retained within the swivel block 16 by a circlip 18. The swivel block 16 is attached to a base 15 by a set of screws, wherein the base 15 provides support for the second motor 21. The base 15 also supports the second hollow spindle 12, the first hollow spindle 3 and the spray nozzle 1, by a bearing thrust 14 and a washer thrust 13. The base 15 provides a means of maintaining the second motor 21 in a non-rotating position relative to the third hollow spindle 23 whilst the second hollow spindle 12 rotates.

The second hollow spindle 12 is provided with an electrical slip ring 33 which enables continuous 360° rotation of the first hollow spindle 3 and the spray nozzle 1 about the central longitudinal axis of the second hollow spindle 12.

The second hollow spindle 12 is rotatably interconnected and substantially perpendicular to the third hollow spindle 23. The second hollow spindle 12 and the third hollow spindle 23 are rotatably interconnected via the swivel block 16. A seal ring 22 is provided therebetween to prevent liquid leaking between the swivel block interface of the second hollow spindle 12 and the third hollow spindle 23.

The third hollow spindle 23 is provided with a third motor 32 configured so as to facilitate, in use, 360° rotation of the third hollow spindle 23. The third hollow spindle 23 is rotated by the third motor 32 through a coupling 3), wherein the coupling 31 is attached to the third hollow spindle 23 by a roll pin 30. The third hollow spindle 23 rotates within a swivel block 27. Leakage of flowing liquid therebetween is prevented by provision of bring seals 28 therebetween. The third hollow spindle 23 is retained within the swivel block 27 by a circlip 29. The swivel block 27 is attached to a base 26 by a set of screws, wherein the base 26 provides support for the third motor 32. The base 26 also supports the third hollow spindle 23, by a bearing thrust 25 and a washer thrust 24. The base 26 also provides a means whereby the spray head may be attached to a vehicle or jib-like attachment. The base 26 provides a means of maintaining the third motor 32 in a non-rotating position relative to a vehicle or jib-like attachment whilst the third hollow spindle 23 rotates.

The third hollow spindle 23 is provided with an electrical slip ring 34 which enables continuous rotation of the spray nozzle 1, the first hollow spindle 3, and the second hollow spindle 12 about the central longitudinal axis of the third hollow spindle 23. The third hollow spindle 23 is also provided with a fluid entry port 35.

The first motor 10, the second motor 21, and the third motor 32 may be operated independently of one another. Each motor may facilitate continuous 360° clockwise or anti clockwise rotation of the corresponding hollow spindle or an oscillatory rotation of the corresponding hollow spindle in a desired angular range such that a fanning action of the spray nozzle 1 is provided. The fanning action may be performed in either a vertical or horizontal plane, or within any region so chosen by an operator.

The spray nozzle 1 may be adjusted to produce a spray pattern which includes a localised jet of liquid or a cone of spray.

Figure 2:
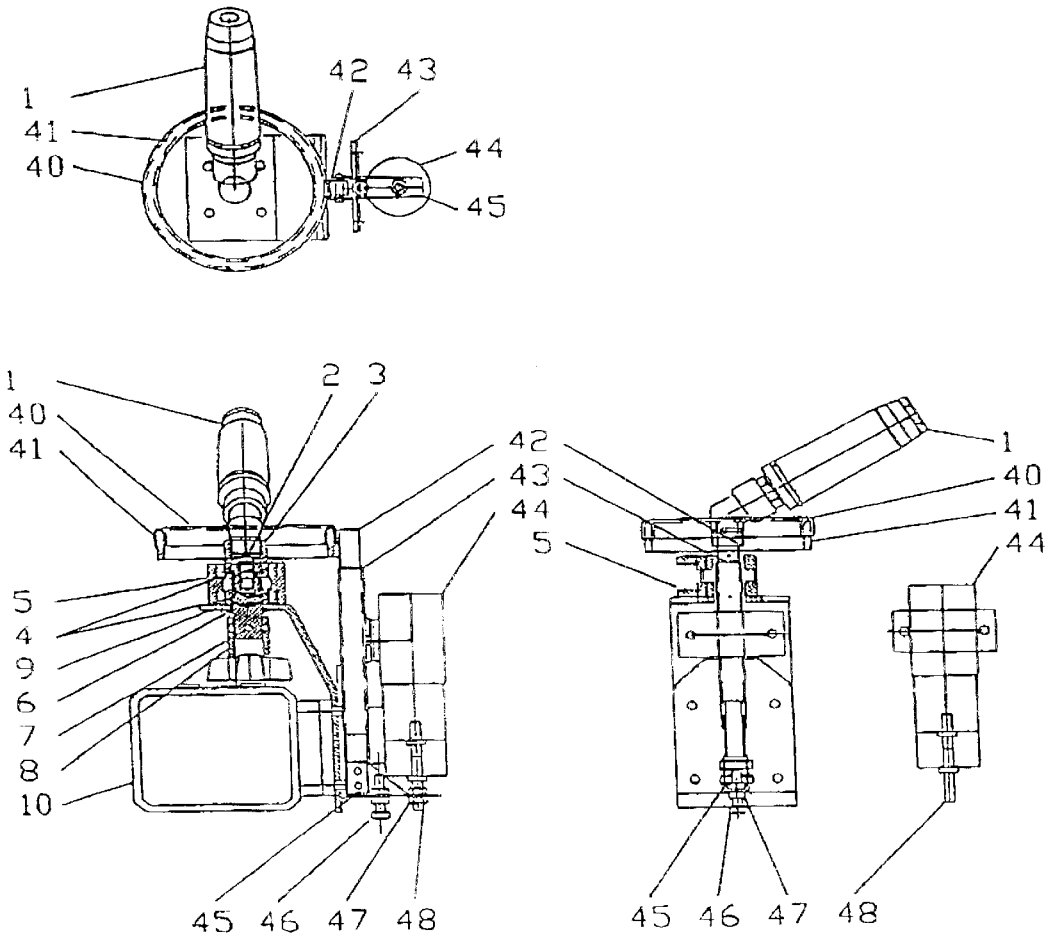
FIG. 2 is a plan view and elevations of a first component of the spray head of FIG. 1.

Referring to FIG. 2 there is shown a means to adjust the spray nozzle 1.

Adjustment of the spray pattern is provided by engaging the spray nozzle 1 with a friction ring 40. The means by which the spray nozzle 1 and the friction ring 40 are engaged includes a solenoid 44, an adjuster bracket 43, an adjuster post 42 and an adjuster ring 41. The solenoid 44 is attached to the adjuster bracket 43. Upon activation of the solenoid 44, the solenoid 44 exerts a force on the adjuster post 42 and adjuster ring 41 such that the friction plate 40 engages the spray nozzle 1. Engagement of the friction plate 40 with the spray nozzle 1 effects rotation of the spray nozzle 1 about a central longitudinal axis of the spray nozzle 1. The friction plate 40 may be accurately positioned by an operator by means of a travel screw 46 secured in place by lock nuts 47.

Figure 3:
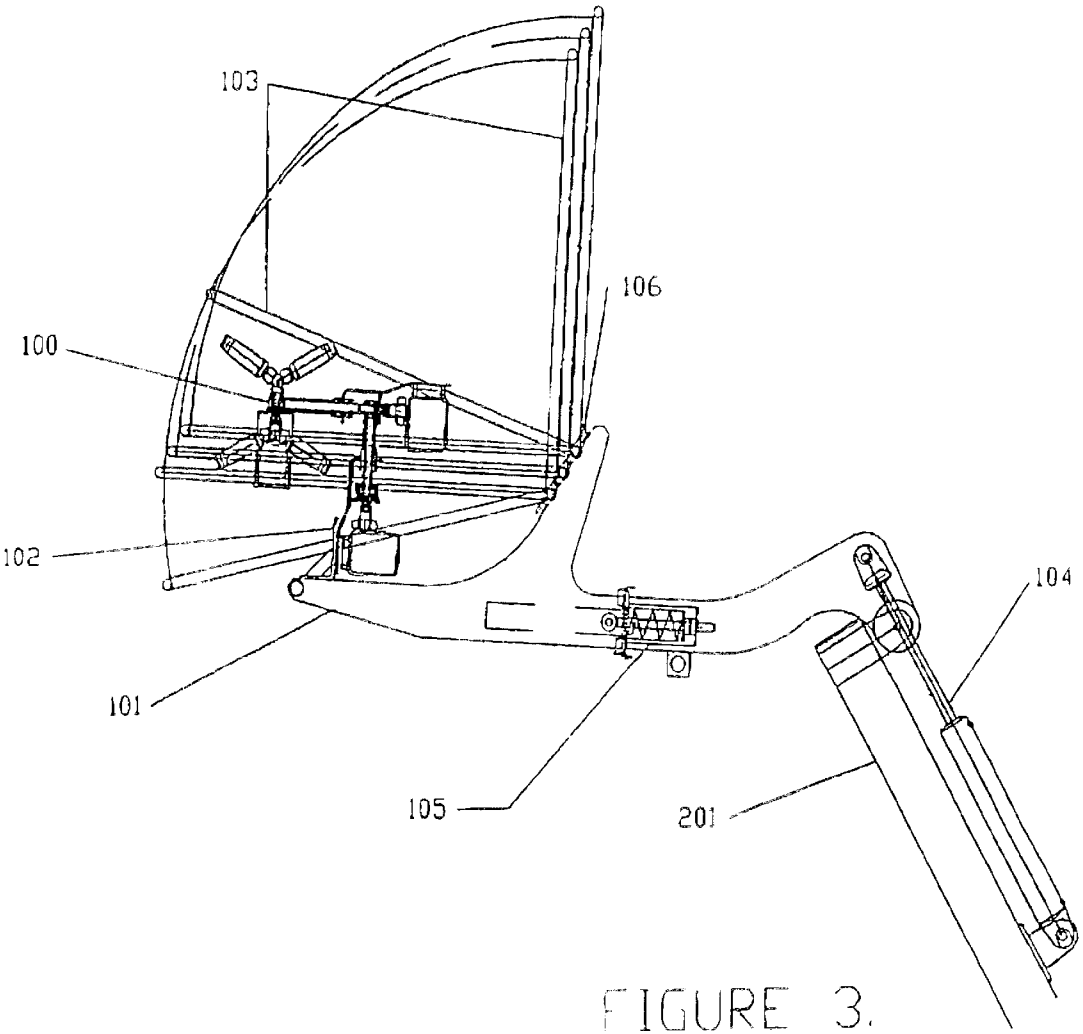
FIG. 3 is a side elevation view of the spray head of FIG. 1 in alternative orientations and attached to an orientation adjustment means.
Figure 4:
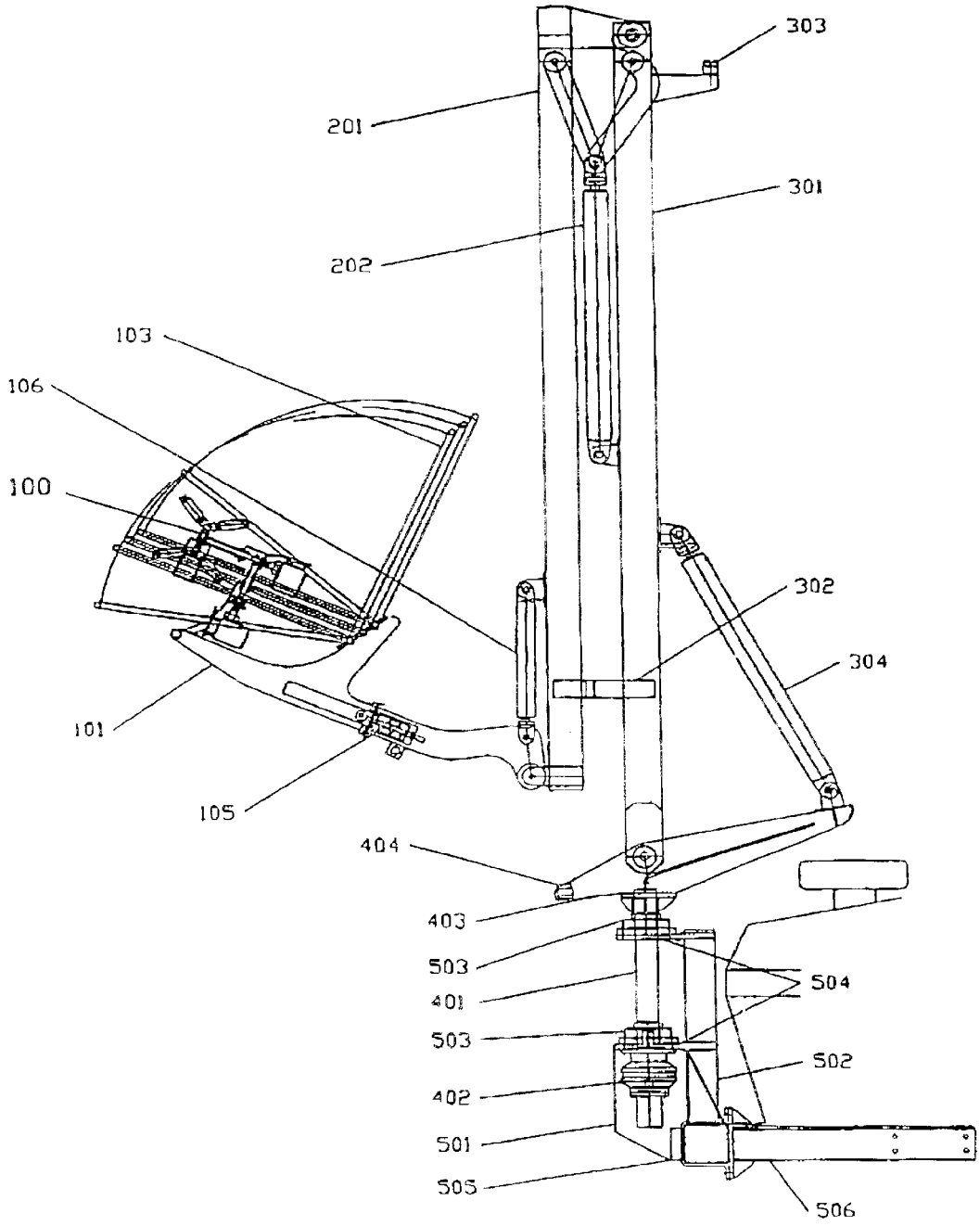
FIG. 4 is a side elevation view of the spray head of FIG. 1 in an alternative orientation and attached to an orientation adjustment means which is in turn attached to an attachment means being a jib-like apparatus.
Figure 5:
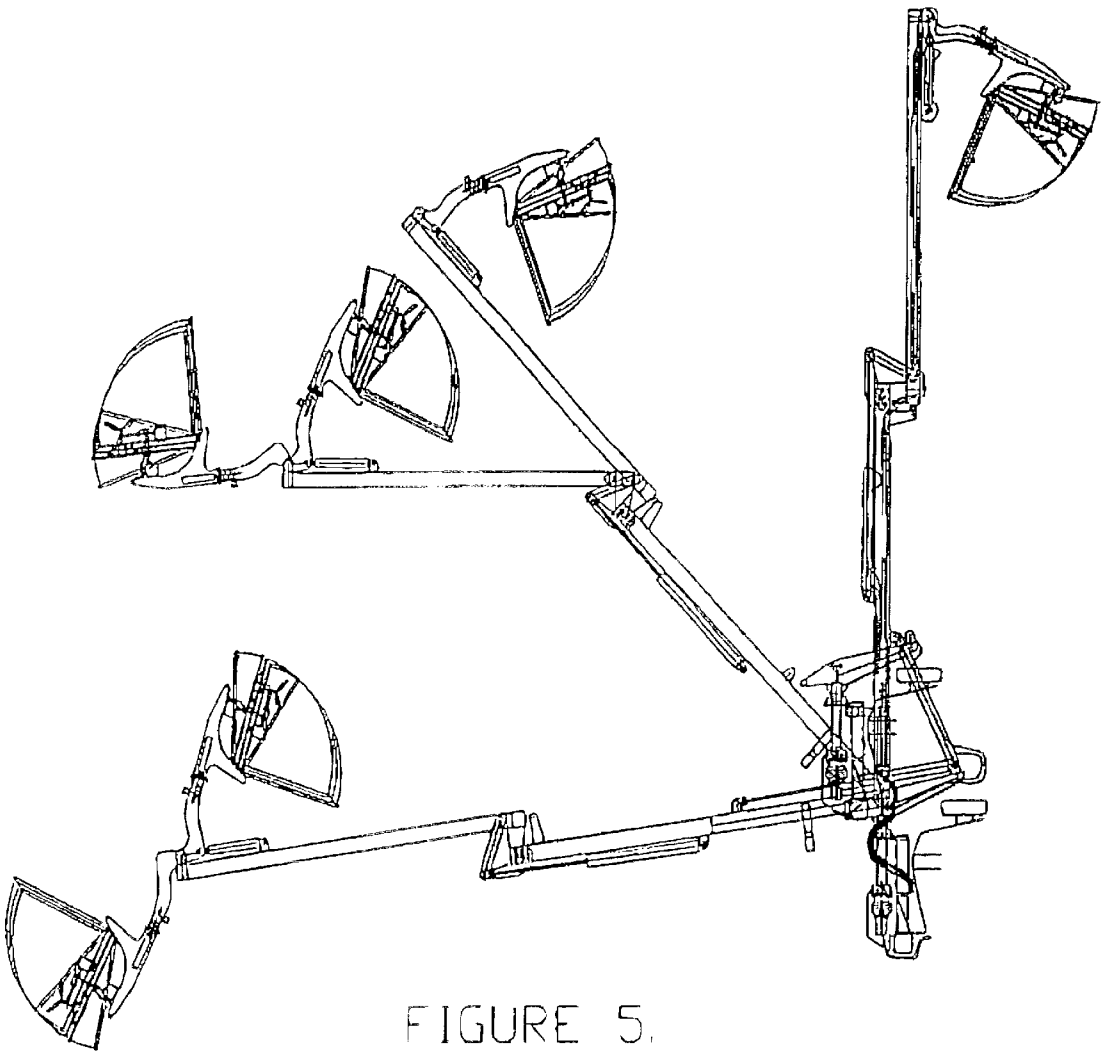
FIG. 5 is a side elevation view of the spray head of FIG. 1 in several alternative orientations.

In a further embodiment, adjustment of the spraying pattern by rotation of the barrel of the spray nozzle 1 about the central longitudinal axis of the spray nozzle 1 may be facilitated by the provision of an extended spindle between the spray nozzle 1 and the swivel block 5 wherein electrical slip rings are attached to the extended spindle, configured so as to electrically connect to a motor, drive mechanism and base so as to facilitate, in use 360° rotation of the spray nozzle barrel about the central longitudinal axis of the spray nozzle 1. Alternatively, a linear actuator may be provided to adjust the spray pattern of the nozzle. Referring to FIGS. 3, 4 and 5 there is shown a spray head 100 as in the present invention attached to a head support arm 101 and a jib extension arm 201.

A head support arm 101 is shown in FIGS. 3, 4 and 5. The head support arm 101 includes a bracket member 102 having the spray head 100 attached.

The head support arm 101 is provided with a plurality of protection rings 103 which are clamped to the head support arm 101 by a clamp 106. In use, the protection rings are adjusted to a desired position by relaxing the clamp 106, positioning the protection rings 103 as desired, then tightening the clamp 106. The purpose of the protection rings 103 is to prevent the spray head 100 from being fouled or damaged within tree branches.

The head support arm 101 is also provided with a spring loaded breakaway 105. In use, when the spray head 100 engages another object, the spring loaded breakaway 105 facilitates the spray head 100 to flex away from the object. The purpose of the spring loaded breakaway 105 is to prevent or minimise damage of the spray head 100 or the spray focus.

The head support arm 101 is also provided with a head support hydraulic cylinder 104 to facilitate, in use, 150°–270° pivotal movement in the vertical plane. Operation of the head support hydraulic cylinder 104 enables the head support arm 101 to pivot such that the spray heads 100 mounted thereon may be moved through any portion of a 150°–270° arc. The purpose of this function is to enable the spray head 100 to be directed downwards over the top of any foliage or directed upward underneath any foliage.

A jib-extension arm 201 is shown in FIGS. 4 and 5. It may be appreciated that the spray head 100 and head support arm 101 may be attached to a jib-extension arm 201, wherein the jib-extension arm 201 provides additional reach and extension. Various orientations and directional adjustments of the spray head 100 and head support arm 101 in use with the jib-extension arm 201 will become apparent by referral to FIG. 5.

The motion of the jib-extension arm 201 will now be described. The motion of the jib-extension arm 201 is dependant on the motion of a jib extension hydraulic cylinder 202 wherein when extended, facilitates the jib-extension arm 201 to move upward in a vertical direction to a filly open position in line with a main jib arm 301, as shown in FIG. 5. This configuration provides maximum reach for the spray head 100, A rubber stop 303 is located on the main jib arm 301 adjacent to pivotal connection between the jib-extension arm and the main jib arm. The rubber stop 303 is provided to stop over travel of the jib-extension arm 201 when fully extended in an upward vertical direction. When the jib extension hydraulic cylinder 202 retracts, it facilitates the jib-extension arm 201 to pivot 180° vertically in a downwards direction until it is finally engaged with a retainer 302 provided in the proximity of the lower end of the main jib arm 301. Sideways movement of the jib-extension arm 201 is prevented when the retainer 302 and the jib-extension arm 201 are engaged. Although the main purpose of this particular configuration is to protect the jib-extension arm 201 during transport, the spray head is operable in this configuration also.

The main jib arm 301 is operated by a main jib hydraulic cylinder 304 which enables the main jib arm 301 to move through an arc of 97° in the vertical direction. Movement of the main jib arm provides means of achieving maximum height or maximum horizontal reach of the spray head 100 in relation to the vehicle to which the main jib arm 301 is attached. A stewing spindle 401 supports and facilitates rotation of the main jib arm 301 about the vertical axis and through an arc of 360° in the horizontal plane. The slewing spindle 401 is provided with a hydraulic gear motor 402 or other driving mechanism from which it is driven at its lower end. The rotational speed of the slewing spindle 401 is determined by a gear reduction ratio within the hydraulic control valve. The upper end of the slewing spindle 401 is attached to a main jib support 403 which facilitates the pivotal connection between the slewing spindle 401 and the main jib arm 301. The main jib support 403 provides anchorage at one end for the main jib hydraulic cylinder 304. A rubber stop 404 is also attached at the other end of the main jib support 403. The purpose of the rubber stop 404 is to prevent over extension of the main jib arm 301.

There is further shown in FIG. 4 a support frame 501 provided with means to be attached to a vehicle chassis. The support frame 501 carries the slewing spindle 401 within two flange type ball bearings 503 which are bolted to bearing brackets 504 attached to an upright pillar 502. The upright pillar 502 is provided at its base with a horizontal torsion member 505 which also acts as a bumper for approaching obstacles such as fallen trunks of trees. The horizontal torsion member 505 is secured to two side arms 506 that are bolted to the sides of the vehicle. The side arms 506 may be adjusted to different widths to cater for variations in vehicles.

Figure 6:
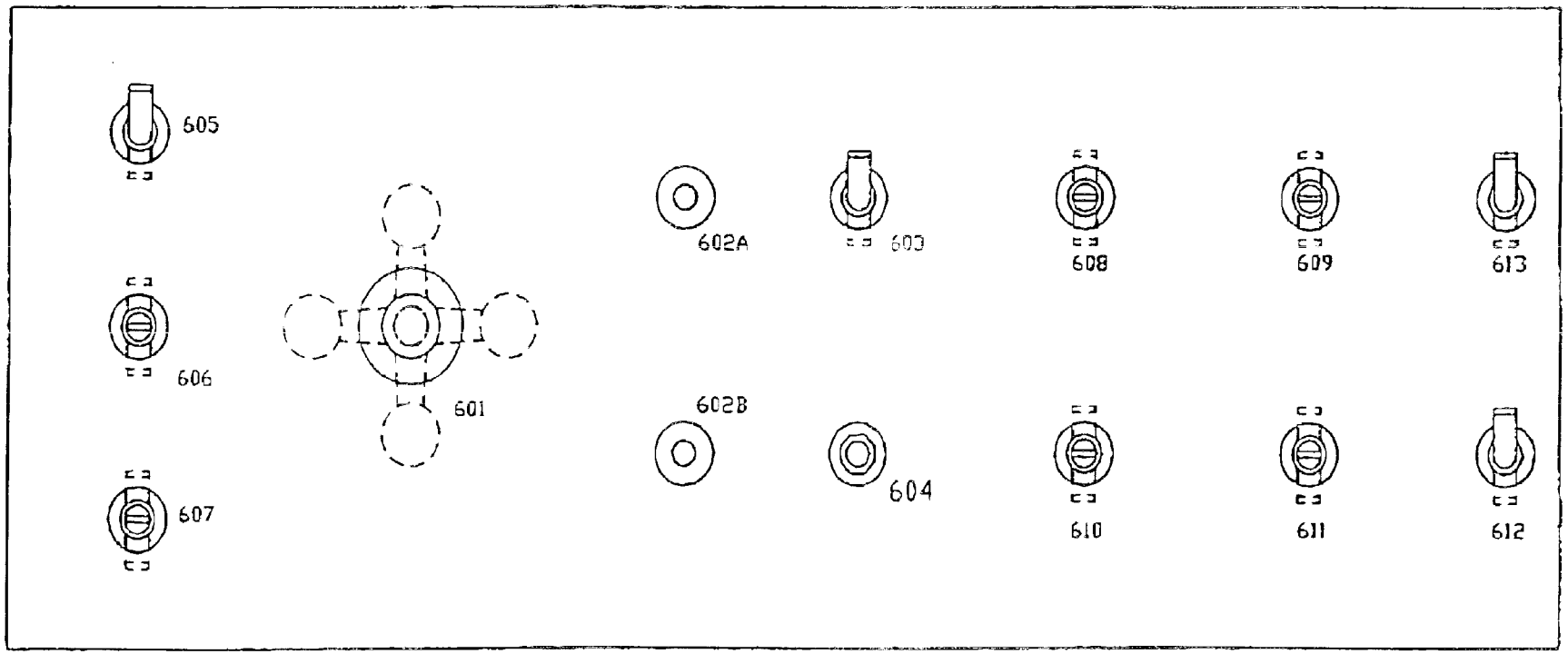
FIG. 6 is a plan view of a remote control console.

A remote control console is shown in FIG. 6. It may be appreciated that operation of the global spray head 100, head support arm 101 and jib-extension arm 201 may be effected by remote control. Various orientations and directional adjustments of the spray head 100 and head support arm 101 in use with the jib-extension arm 201 will become apparent by referral to FIG. 6.

A remote control console is provided with a spraying pattern adjustment switch 606 to adjust the spraying pattern of the spray nozzle 1 from a localised jet of liquid to a cone of spray. The spraying pattern adjustment switch 606 is a three position switch—momentary forward/off/momentary reverse. Both the forward and reverse positions are spring loaded momentary. When the switch is moved to either the momentary forward or momentary reverse positions, two circuits simultaneously activate the first motor 10 which causes spray nozzle 1 to rotate and solenoid 44 which exerts a force on the adjuster post 42 and adjuster ring 41 such that the friction ring 40 engages barrel of the spray nozzle 1. When the spraying pattern adjustment switch 606 is moved forward, the first motor 10 rotates the spray nozzle 1 in an anti-clockwise direction, and at the same time the adjuster ring 41 is brought into contact with the barrel of the spray nozzle 1 which adjusts the spraying pattern to a solid cone of liquid.

When the spraying pattern adjustment switch 606 is moved backwards, the first motor 10 rotates the spray nozzle 1 in a clockwise direction, and at the same time the adjuster ring 41 is brought into contact with the barrel of the spray nozzle 1 which adjusts the spraying pattern to a direct localised jet of liquid. The remote control console is also provided with two spray nozzle positioning switches 602A and 602B. When switch 602A is depressed, the first gear motor 10 facilitates clockwise rotation of the first hollow spindle 3 and the spray nozzle 1. When switch 602B is depressed, the first gear motor 10 facilitates anti-clockwise rotation of the first hollow spindle 3 and the spray nozzle 1. Releasing either switch halts movement of the spray nozzle in the respective direction.

The remote control console is also provided with an oscillation control switch 603. The oscillation control switch 603 is a two position switch. One position allows the operator to manually oscillate the spray nozzle by alternately depressing spray nozzle 1 positioning switches 602A and 602B. The arc of oscillation of the spray nozzle 1 in operation is proportional to the period of time that each of switches 602A and 602B is depressed The alternate position of the oscillation control switch 603 effects automatic oscillation of the spray nozzle 1. The arc of oscillation of the spray nozzle 1 in operation is determined by an oscillation amplitude potentiometer 604. The oscillation amplitude potentiometer 604 varies the degree of arc of oscillation about its last manually set position.

Control of the spray liquid flowing to the spray head 100 is facilitated by a liquid control switch 607. The liquid control switch 607 is a three position switch—momentary on/off/on. Selection of the pulse position enables short bursts of liquid to flow through the spray head 100, whereas selection of the on position enables a continuous flow of liquid through the spray head 100.

The remote control console is provided with a joystick 601 which controls the movements of second motor 21 and third motor 32. A forward and backward positioning of the joystick 601 will result in clockwise and anti-clockwise rotation, respectively, of second hollow spindle 12, the first hollow spindle 3, and the spray nozzle 1 about the central longitudinal axis of the second hollow spindle 12. Positioning of the joystick 601 to the left or right position will result in anti-clockwise and clockwise rotation, respectively, of the third hollow spindle 23, the second hollow spindle 12, the first hollow spindle 3, and the spray nozzle 1 about the central longitudinal axis of the third hollow spindle 23. The result of combining the forward-backward movements and sideways movements of the joystick is to direct the spray nozzle simultaneously in the vertical and horizontal planes.

Referring to FIG. 6 there is shown a control console provided with a head support arm switch 611, a jib extension switch 609, a main jib switch 608 and a stewing spindle switch 610. The purpose of the head support arm switch 611 is to operate the hydraulic system necessary to raise and lower the head support arm 101. The head support arm switch 611 is a three position switch—momentary on/off/momentary on. Movement of the switch to the forward position extends and lowers the head support arm 101 and the spray head 100 to its most extendable position. When the head support arm switch 611 is in the rear position, the head support arm 101 and the spray head 100 are retracted and raised onto a parked or travelling position.

The purpose of the jib extension switch 609 is to operate the hydraulic system necessary to raise and lower the jib-extension arm 201. The jib extension switch 609 is a three position switch—momentary on/off/momentary on. Movement of the jib extension switch to the forward position extends and raises the jib-extension arm 201 to its most extended position. When the jib extension switch 609 is in the rear position the jib-extension arm retracts and to is lowered into a parked or travelling position.

The purpose of the main jib switch 608 is to operate the hydraulic system necessary to raise and lower the main jib arm 301. The main jib switch 608 is a three position switch momentary on/off/momentary on. Movement of the main jib switch 608 to the forward position extends and lowers the main jib arm 301 to its most extended position. When the main jib switch 608 is in the rear position the main jib arm 301 retracts and is raised into a parked of travelling position.

The purpose of the slewing spindle switch 610 is to operate the hydraulic system which enables the stewing spindle 401 to rotate. The slewing spindle switch 610 is a three position switch—momentary on/off/momentary on. Movement of the stewing spindle switch 610 to the left or right enables the stewing spindle to rotate in an anti-clockwise or clockwise direction, respectively.

The remote control console is also provided with a home position switch 612 which is a momentary on/off switch. The purpose of the home position switch 612 is to simultaneously operate the spray head 100, head support arm 101, main jib arm 301 and jib-extension arm 201, such that they return to a parked or travelling position. A microprocessor is provided which receives positioning information from several potentiometers coupled to the respective shafts of the first motor 10, second motor 21 and third motor 32 as well as the solenoids operating the jib arm hydraulic cylinders 106, 202, 304.

A remote control console isolation switch 613 is also provided with an on/off function which enables an operator to disconnect power from the various switches on the remote control console. Accidental operation of the console functions during travelling may be avoided.

An auxiliary switch 605 with a two position on/off functionality is also provided. The auxiliary switch 605 controls a solenoid which diverts spray liquid to an alternative outlet other than the spray head 100.

Alternatively, it will be appreciated that operation of the spray head 100, and various orientation adjustment means may be effected by a joystick-type control which incorporates and integrates all possible operations within the one joystick-type unit.

Figure 7:
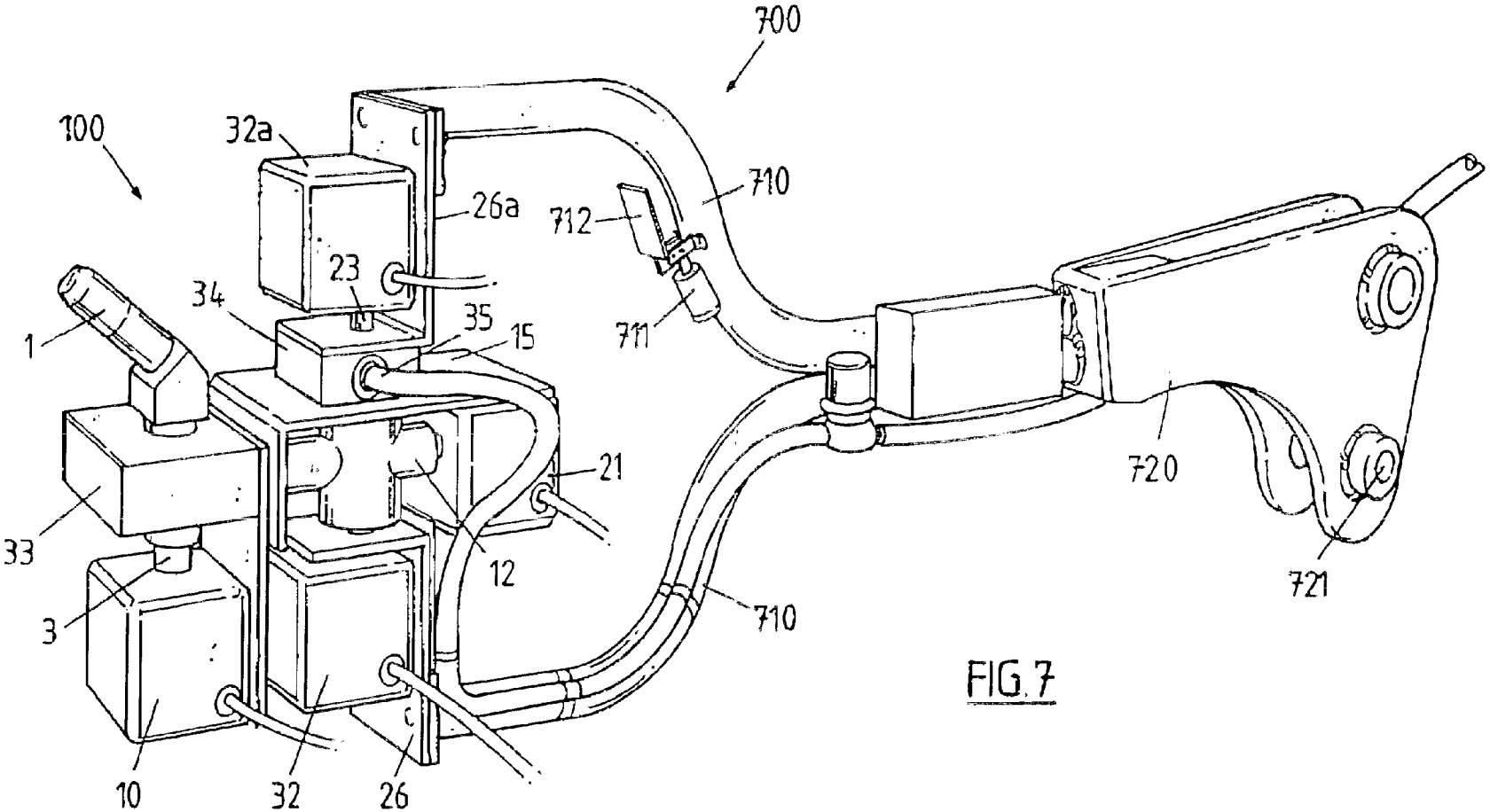
FIG. 7 is a diagrammatic perspective view of the spray head of the previous figures shown with additional features and attached to an alternative orientation adjustment means.

Referring to FIG. 7 there is shown a spray head 100 having additional features and attached to an alternative orientation adjustment means 700. It will be appreciated that like numbers denote like features described previously.

It is envisaged that the third hollow spindle 23 may be provided with an additional third motor 32*a* on an opposing end of the third hollow spindle 23, configured so as to facilitate, in use, 360° rotation of the third hollow spindle 23 about the central longitudinal axis of the third hollow spindle 23. The additional third motor 32*a* is arranged to operate with the third motor 32 in order to facilitate 360° rotation of the third hollow spindle 23 about the central longitudinal axis of the third hollow spindle.

It will also be envisaged that the additional third motor 32*a* is provided with a corresponding base 26*a* to provide a support for the additional third motor 32*a*. The bases 26, 26*a* also provide a means whereby the spray head 100 may be attached to the alternative orientation adjustment means 700 shown in FIGS. 7 and 8.

Figure 8:
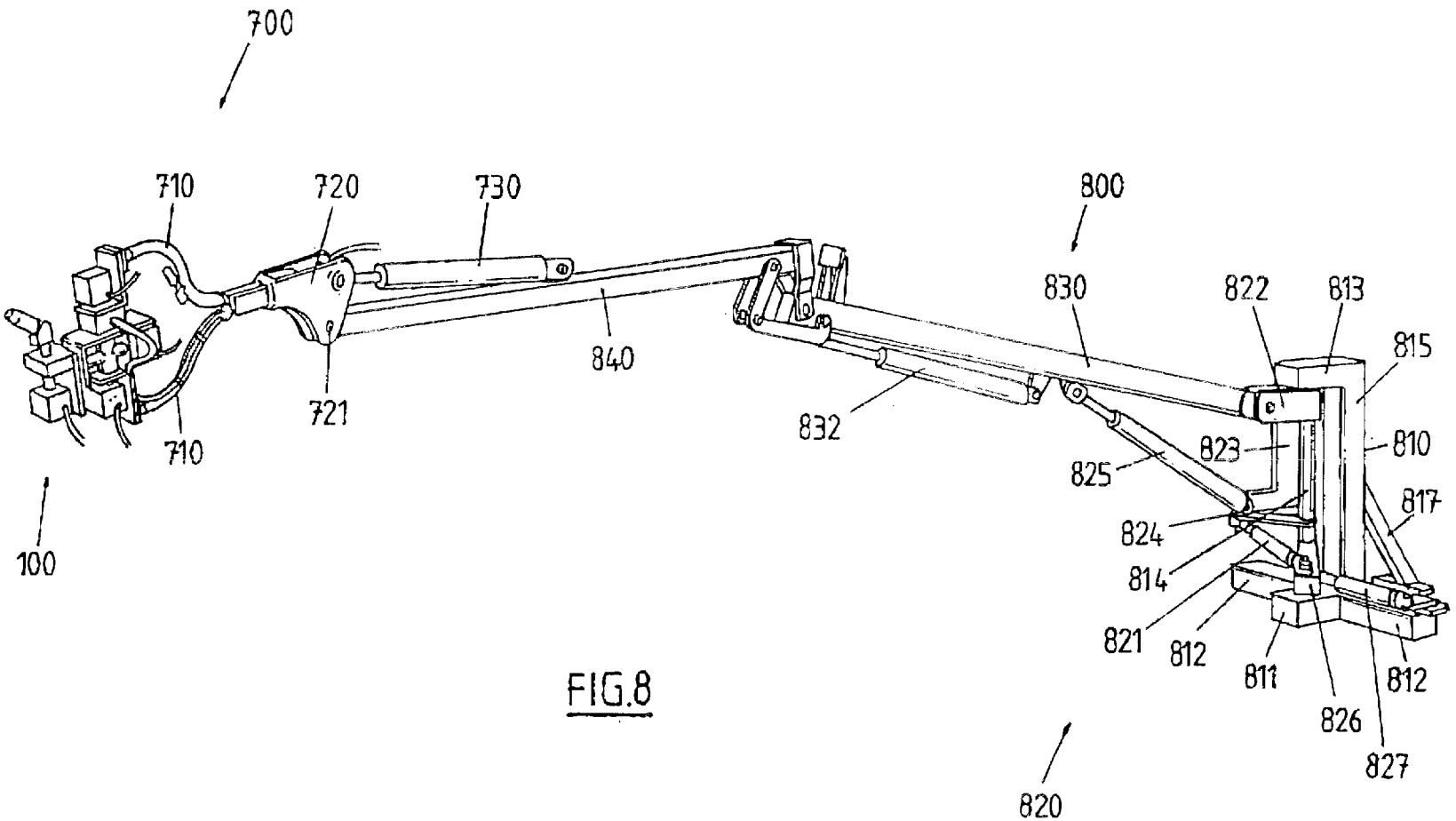
FIG. 8 is a diagrammatic perspective view of the spray head of FIG. 7 attached to an alternative orientation adjustment means which is in turn attached to an alternative jib-like apparatus.

As shown in FIGS. 7 and 8, the alternative orientation adjustment means 700 includes two diverging connecting members 710, wherein each diverging connecting member 710 is arranged to be endwise connected with the corresponding base 26, 26*a*. Opposing ends of each diverging connecting member 710 are fixedly attached to a pivot member 720.

The pivot member 720 is pivotally connected to a jib extension arm 840 at pivot point 721. The pivot member 720 is provided with a pivot member hydraulic cylinder 730 which is also attached to the jib extension arm 840 to facilitate, in use, 150°–270° pivotal movement in the vertical plane about pivot point 721. Operation of the pivot member hydraulic cylinder 730 enables the pivot member 720 to pivot such that the spray head 100 mounted on the diverging connecting members 710 may be moved through any portion of a 150°–270° arc. The purpose of this function is to enable the spray head 100 to be directed downwardly from above foliage or directed upwardly from beneath foliage.

In FIG. 8 there is shown the spray head 100, an alternative adjustment means 700 and an alternative jib-like apparatus 800. The alternative jib-like apparatus 800 includes a support base 810, a slewing means 820, a jib arm 830 and a jib extension arm 840.

The support base 810 includes a substantially horizontal lower end member 811 and a substantially horizontal upper end member 813 endwise interconnected by a substantially vertical first web member 815. The lower end member 811 is provided with two substantially horizontal transversely aligned foot members 812. Each foot member 812 is disposed adjacent a lower end of the web member 815. An intermediate portion of the first web member 815 is provided with a downwardly inclined support member 817. The support member 817 is aligned with the lower end member 811 and is disposed on the appropriate side of the support base 810 from the lower end member 811.

The slewing means 820 is arranged to be housed and supported by the support base 810. The stewing means 820 includes a substantially vertical stewing spindle 814 which is disposed adjacent respective free ends of the upper and lower end members 811, 813 and is to arranged to interconnect said upper and lower end members 811, 813. An upper portion of the slewing spindle 814 is provided with an outwardly extending upper arm 822 which is pivotable about the stewing spindle 814. An intermediate portion of the stewing spindle 814 is provided with an outwardly extending intermediate arm 824 which is also pivotable about the stewing spindle 814. The upper and intermediate arms 822, 824 are fixedly interconnected by a substantially vertical second L-shaped web member 823. A lower portion of the stewing spindle 814 is provided with an outwardly extending lower arm 826 which is also pivotable about the stewing spindle 814. An underside of an outermost end of the intermediate arm 824 is fixedly attached to one end of a first hydraulic cylinder 821. An opposing end of the first hydraulic cylinder 821 is fixedly attached to the lower arm 826. An end of a second hydraulic cylinder 827 is also fixedly attached to the lower arm 826. An opposing end of the second hydraulic cylinder 827 is fixedly attached to one of the transversely aligned foot members 812 The first hydraulic cylinder 821 is arranged, in use, to pivot the intermediate arm 824 and the upper arm 822 about the slewing spindle 814. The second hydraulic cylinder 827 is arranged, in use, to pivot the lower, intermediate and upper arms 826, 824, 822 about the slewing spindle. Pivotal movement of the jib arm 830 is afforded by sequential expansion of the first and second hydraulic cylinders 821, 827. The second hydraulic cylinder 827 is arranged, in use, to pivot the intermediate and upper arms 824, 822 in relation to the lower arm 826. Pivotal movement of the jib arm 830 in an opposing direction is facilitated by sequential contraction of the second hydraulic cylinder 827 and of the first hydraulic cylinder 821. In this way the slewing means facilitates pivotal movement of the jib arm 830 and the jib extension arm 840 about the slewing spindle 814. Preferably the arc of rotation of the jib arm 830 and the jib extension arm 840 is 280 degrees.

An outermost end of the upper arm 822 is pivotally connected to an end of the elongate jib arm 830. A mid portion of the elongate jib arm 830 is pivotally attached to an end of a third hydraulic cylinder 825. An opposing end of the third hydraulic cylinder 825 is fixedly attached to an upper side of the outermost end of the lower arm 824. The third hydraulic cylinder 825 is arranged, in use, to pivot the elongate jib arm 830 vertically about the outermost end of the upper arm 822 of the stewing means 820.

An opposing end of the elongate jib arm 830 is pivotally connected with an end of the elongate jib extension arm 840. The elongate jib arm 830 is provided with a fourth hydraulic cylinder 832 which is arranged and configured to facilitate vertical pivotal movement of the jib extension arm 840 about the end of the elongate jib arm 830. Thus, in an extended position the jib extension arm 840 is outwardly extended from and substantially longitudinally aligned with the jib arm 830, and in a folded position the jib extension arm 840 is disposed adjacent the length of the jib arm 830.

It will be appreciated that alternative means for adjustment of the spray nozzle 1 may be provided. Referring to FIG. 7, there is shown a solenoid 711 and a lever 712 mounted on one of the diverging connecting members 710. The lever 712 is movable between an extended and retracted position. The solenoid 711 is arranged to actuate the lever between the extended and retracted positions. Adjustment of the spray nozzle 1 is facilitated by rotating the spray head 100 about the central longitudinal axis of the third hollow spindle 23 until an outer housing of the spray nozzle 1 engages with tie lever 712 in the extended position Rotation of the spray head 100 about the central longitudinal axis of the third hollow spindle 23 causes the outer housing of the spray nozzle 1 to tighten or to loosen in either direction in response to engagement with the extended lever 712, thereby adjusting the spray discharge pattern of the spray nozzle 1.

Alternatively, it will be envisaged that the spray nozzle 1 may be provided with direct drive geared motor which is configured and arranged in use to tighten or loosen the outer housing of the spray nozzle 1 to adjust the spray discharge pattern of the spray nozzle 1.

It is also envisaged that each hollow spindle will be provided with at least one transformer device 70. Preferably, the or each transformer device comprises an electrically conducting coil set 72 arranged, in use, to be integral with a wall of the hollow spindle. The coil set 72 includes a primary winding 74 and a secondary winding 76 in close proximity. Preferably, the primary and secondary windings 74, 76 are made from ferrite around which a solenoid type coil is wound, an amorphous wound metal ribbon, or litz wire made from many insulated strands.

The primary winding 74 has a first annulus of indefinite length longitudinally aligned and integral with the wall of the hollow spindle. The secondary winding 76 has a second annulus of indefinite length longitudinally aligned and integral with the wall of the hollow spindle. It will be appreciated that the first annulus may be arranged to encompass the second annulus in order to facilitate current flow between the first and second windings 74, 76 of the electrically conducting coil set 72. Alternatively, it Will be appreciated that a face of the first annulus may be disposed adjacent a face of the second annulus to facilitate current flow between the first and second windings 74, 76 of the electrically conducting coil set 72.

The provision of an electrically conducting coil set for each hollow spindle allows for communication of electrical power, control signals and sensing to the respective motor, thereby eliminating external electrical conduits to each motor.

In this way, the spray head provides a parallel passage for fluid flow and current flow through the hollow spindles of the spray head without the necessity for extraneous hollow tubing and electrical cables. Consequently, continuous rotation of the three perpendicularly aligned hollow spindles of the spray head is afforded without restriction. Furthermore, the respective passages for fluid flow and current flow are discrete although combined in the one spray head device.

Modifications and variations as would be apparent to a skilled addressee are deemed to be within the scope of the present invention.

What is claimed is:

1. A spray head comprising at least three hollow spindles, each of the spindles having a central longitudinal axis and a wall disposed about the central longitudinal axis, each outer wall having an inner surface, a first hollow spindle having a spray nozzle mounted thereto, a second hollow spindle connected to the first hollow spindle and a third hollow spindle connected to the second hollow spindle, the third hollow spindle being provided with a fluid entry port, each of the hollow spindles being provided with means for imparting rotation to each hollow spindle including the respective wall thereof about the central longitudinal axis of each hollow spindle, the hollow spindles being independently rotatable, each hollow spindle being angularly disposed relatively to the or each other hollow spindle to which it is connected, and the first, second and third hollow spindles having a fluid flow path extending from the fluid entry port of the third hollow spindle sequentially through the third hollow spindle, the second hollow spindle and the first hollow spindle to the spray nozzle, fluid passing through the first, second and third hollow spindles being laterally constrained by the inner surfaces of the walls of the rotatable hollow spindles.

2. A spray head according to claim 1 wherein each of the hollow spindles is arranged to be axially rotated independently of the other hollow spindles.

3. A spray head according to claim 1, wherein each hollow spindle is rotatably connected to an adjacent hollow spindle.

4. A spray head according to claim 1, wherein each hollow spindle is substantially perpendicular to an adjacent hollow spindle.

5. A spray head according to claim 1, wherein each hollow spindle is arranged to rotate through any angle up to and beyond 360° about a central longitudinal axis of the hollow spindle.

6. A spray head according to claim 1, wherein each hollow spindle is arranged to oscillate in a desired angular range determined by an operator.

7. A spray head according to claim 1, wherein each hollow spindle is provided with at least one motor to facilitate axial rotation of each hollow spindle.

8. A spray head according to claim 7, wherein each hollow spindle is provided with at least one transformer device to permit an electrical connection to the respective motor or motors through the hollow spindle.

9. A spray head according to claim 8, wherein the transformer device includes a primary winding and a secondary winding in close proximity, wherein the primary and secondary windings are arranged to be integral with a wall of the hollow spindle.

10. A spray head according to claim 9, wherein the primary winding encompasses the secondary winding.

11. A spray head according to claim 9, wherein the primary winding is endwise adjacent with the secondary winding.

12. A spray head according to claim 1, wherein the spray nozzle extends away from the first hollow spindle at an acute angle and is arranged for rotation with the first hollow spindle.

13. A spray head according to claim 12, wherein the spray nozzle is provided with means for adjusting a spray pattern of the spray nozzle.

* * * * *